US011559912B2

(12) United States Patent
Saltas et al.

(10) Patent No.: US 11,559,912 B2
(45) Date of Patent: Jan. 24, 2023

(54) SHAVING BLADE ASSEMBLY

(71) Applicant: BIC VIOLEX S.A., Anoixi (GR)

(72) Inventors: Efthimios Saltas, Athens (GR); Dionysios Athanassiou, Athens (GR); Panagiotis Moustakas, Athens (GR); Christoforos Athanassios Brellis, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 164 days.

(21) Appl. No.: 16/962,657

(22) PCT Filed: Dec. 20, 2018

(86) PCT No.: PCT/EP2018/086140
§ 371 (c)(1),
(2) Date: Jul. 16, 2020

(87) PCT Pub. No.: WO2019/141482
PCT Pub. Date: Jul. 25, 2019

(65) Prior Publication Data

US 2020/0346359 A1 Nov. 5, 2020

(30) Foreign Application Priority Data

Jan. 17, 2018 (EP) ..... 18152158

(51) Int. Cl.
*B26B 21/40* (2006.01)
*B26B 21/22* (2006.01)

(52) U.S. Cl.
CPC ..... *B26B 21/4031* (2013.01); *B26B 21/227* (2013.01); *B26B 21/4018* (2013.01); *B26B 21/4025* (2013.01); *B26B 21/4062* (2013.01)

(58) Field of Classification Search
CPC ..... B26B 21/14; B26B 21/16; B26B 21/22; B26B 21/227; B26B 21/40;
(Continued)

(56) References Cited

U.S. PATENT DOCUMENTS 2,691,217 A * 10/1954 Clark ..... B26B 21/00 30/50
3,667,121 A 6/1972 Dorion et al.
(Continued)

FOREIGN PATENT DOCUMENTS

CN 1270548 A 10/2000
CN 104428108 A 3/2015
(Continued)

OTHER PUBLICATIONS

International Search Report and Written Opinion issued in International Application PCT/EP2018/086140, dated Mar. 29, 2019 (8 pages).
(Continued)

*Primary Examiner* — Jason Daniel Prone
(74) *Attorney, Agent, or Firm* — Bookoff McAndrews, PLLC

(57) ABSTRACT

A shaving blade assembly and a method of using a shaving blade assembly may include a blade, a resilient element, and a first moveable member. The resilient element may support the blade and be arranged to urge the blade in a first direction orthogonal to a cutting edge of the blade. The first movable member may abut the blade in a second direction opposite to the first direction and be held in at least one position.

18 Claims, 2 Drawing Sheets

(58) Field of Classification Search
CPC ..... B26B 21/4012; B26B 21/4018; B26B 21/4031; B26B 21/4062
USPC ..... 30/47–51
See application file for complete search history.

(56) References Cited

U.S. PATENT DOCUMENTS

| | | | | |
|---|---|---|---|---|
| 3,972,114 | A * | 8/1976 | Chao | B26B 21/40 30/50 |
| 5,005,288 | A * | 4/1991 | Wilk | B26B 21/4062 30/41 |
| 5,402,574 | A * | 4/1995 | Milner | B26B 21/227 30/50 |
| 8,689,448 | B2 * | 4/2014 | Ren | B26B 21/4012 30/50 |
| 9,539,734 | B1 | 1/2017 | Bozikis et al. | |
| D832,514 | S * | 10/2018 | Bozikis | D28/47 |
| D832,515 | S * | 10/2018 | Bozikis | D28/47 |
| D832,516 | S * | 10/2018 | Bozikis | D28/47 |
| 10,093,030 | B2 * | 10/2018 | Efthimiadis | B26B 21/4012 |
| 10,414,057 | B2 * | 9/2019 | Ntavos | B26B 21/227 |
| 10,464,226 | B2 * | 11/2019 | Bozikis | B26B 21/227 |
| 10,583,575 | B2 * | 3/2020 | Ntavos | B26B 21/4012 |
| 10,639,806 | B2 * | 5/2020 | Bozikis | B26B 21/4012 |
| 10,723,031 | B2 * | 7/2020 | Park | B26B 21/4012 |
| 10,744,662 | B2 * | 8/2020 | Bozikis | B26B 21/4018 |
| 10,751,894 | B2 * | 8/2020 | Georgakis | B26B 21/4018 |
| 10,800,056 | B2 * | 10/2020 | Kim | B26B 21/4012 |
| 10,836,059 | B2 * | 11/2020 | Efthimiadis | B26B 21/227 |
| 10,913,172 | B2 * | 2/2021 | Moustakas | B26B 21/4012 |
| 10,919,166 | B2 * | 2/2021 | Ntavos | B26B 21/227 |
| 10,946,540 | B2 * | 3/2021 | Bozikis | B26B 21/227 |
| 11,000,961 | B2 * | 5/2021 | Brellis | B26B 21/4012 |
| 11,084,179 | B2 * | 8/2021 | Panagiotopoulou | B26B 19/40 |
| 11,090,824 | B2 * | 8/2021 | Bozikis | B26B 21/4025 |
| 11,090,825 | B2 * | 8/2021 | Bozikis | B26B 21/4018 |
| 11,117,277 | B2 * | 9/2021 | Bozikis | B26B 21/227 |
| 11,224,982 | B2 * | 1/2022 | Efthimiadis | B26B 21/4068 |
| 11,235,485 | B2 * | 2/2022 | Kallivretaki | B26B 21/4012 |
| 2008/0256800 | A1 * | 10/2008 | Nicoll | B26B 21/4018 30/50 |
| 2011/0289779 | A1 * | 12/2011 | Volodin | B26B 21/227 30/50 |
| 2011/0308089 | A1 | 12/2011 | Bridges | |
| 2013/0097872 | A1 * | 4/2013 | Blatter | B26B 21/4018 30/50 |
| 2016/0346944 | A1 | 12/2016 | Sadrialaei | |
| 2020/0346357 | A1 * | 11/2020 | Skodras | B26B 21/4062 |
| 2020/0353633 | A1 * | 11/2020 | Athanassiou | B26B 21/4062 |
| 2021/0031389 | A1 * | 2/2021 | Bozikis | B26B 21/4031 |
| 2021/0162613 | A1 * | 6/2021 | Efthimiadis | B26B 21/4012 |
| 2021/0213630 | A1 * | 7/2021 | Chatzigrigoriou | B26B 21/4031 |
| 2021/0245377 | A1 * | 8/2021 | Paspatis | B26B 21/4062 |
| 2021/0394381 | A1 * | 12/2021 | Bozikis | B26B 21/4068 |

FOREIGN PATENT DOCUMENTS

| | | | |
|---|---|---|---|
| CN | 107000233 | A | 8/2017 |
| DE | 102004020650 | A1 | 11/2005 |
| WO | 2016102024 | A1 | 6/2016 |
| WO | 2018007133 | A1 | 1/2018 |

OTHER PUBLICATIONS

Chinese Office Action in corresponding Chinese Application No. 2018800794252, dated Aug. 11, 2021 (10 pages).

* cited by examiner

SHAVING BLADE ASSEMBLY

TECHNICAL FIELD

This application is a National Stage Application of International Application No. PCT/EP2018/086140, filed on Dec. 20, 2018, now published as WO2019/141482 and which claims the priority benefit of European Patent Application number EP18152158.4 filed on Jan. 17, 2018.

The present description relates to a shaving blade assembly, and more specifically, to a shaving blade assembly comprising a blade, a resilient element supporting the blade and arranged to urge the blade in a first direction orthogonal to a cutting edge of the blade; and a first movable member configured to abut the blade in a second direction opposite to the first direction and to be held in at least one position. The shaving blade assembly may be specifically adapted for shaving facial, head, and/or body hair. The shaving blade assembly may further include a housing with an upper stop against which the resilient element may urge the blade in the first direction and may be adapted to be attached to a razor handle, possibly interchangeably, in particular when a razor blade or blades of the shaving blade assembly has been blunted.

DESCRIPTION OF RELATED ART

Shaving blade assemblies comprising a plurality of blades with adjustable exposure mechanisms are commonly known in the art. However, a majority of the adjustable shaving blade assemblies have features that adjust the mechanism by moving or rotating the guard bar with respect to one or more fixed blades. For example, U.S. Pat. No. 3,667,121 discloses a razor including a handle portion having a mounting means for adjusting the blade exposure by moving the guard bar in different positions. However, in this patent, the guard bar is being adjusted rather than the blades themselves.

In another example, U.S. Patent Application Publication number 2016/0346944 A1 discloses a shaving blade assembly that adjusts the blade exposure by moving the blades toward and away from the shaving plane. The blades of the multi-blade razor are coupled to a rotating mechanism which is turned into a cleaning position that is substantially perpendicular to the shaving plane.

In another example, German Patent Application Publication number DE 10 2004 020 650 A1 includes a semi-circled lever that is located on the shaving blade assembly. In this disclosure, the head of the razor is adjusted by rotating a lever around an asymmetrically positioned axle. The angle of the blades may be adjusted with sliding elements assembled on a rail and is moved by an arrangement of toothed wheels. However, in the two previous examples, the blades are adjusted by rotating the blades relative to the shaving plane.

In another example, International Patent Application Publication number 2018/007133 A1 discloses a shaving cartridge with connectors on each side portion of the plurality of side portions of the housing and a plurality of cutting members. Each of the connectors is elastic, thus, resilient and is operable to permit the side portions to pivot relative to each other. Thus, the housing will assume different configurations and is operable to adapt to and follow a contour defined by a shaving surface.

SUMMARY

This concept intends to improve the shaving performance by adjusting the blade geometry substantially planar with a shaving plane with the blade cartridge adjustment mechanism located on the shaving blade assembly.

The major benefit of the presented concept is an improved shaving performance because the blades may be adjusted by manual means giving a user the option to choose in a range of "bold" shaving to "sensitive" shaving. Additionally, the user may choose among different options of blade geometries to adjust how close the blade will come to the shaving plane.

The shaving plane is defined by a tangent line intersecting the top surfaces of a guard bar located on the front side of a housing of the shaving blade assembly and a cap located at the rear side of the housing. The term "exposure" as used herein is intended to mean the perpendicular distance from the cutting edge of a blade to the shaving plane. For a person skilled in the art the blade exposure is typically considered positive when the blade edge is disposed above this tangent line, effectively extending out of the housing 20, and is considered negative when the blade edge is positioned below this tangent line, inside of the housing 20, at a rest position. For example, a user may be more susceptible to skin irritation and, for that reason, desire a larger distance between the cutting edge of the blade and the shaving plane in a negative direction. Alternatively, another user may desire a smoother shaving result, which requires a closer working position with respect to the shaving plane.

Yet another benefit of the present concept is that the user may adjust the blade geometry without the use of a tool and at any time before, after, or during the shaving process.

A first aspect of the present disclosure relates to providing a shaving blade assembly comprising a blade, a resilient element supporting the blade and arranged to urge the blade in a first direction orthogonal to a cutting edge of the blade, and a first movable member configured to abut the blade in a second direction opposite to the first direction and to be selectively held in at least one position.

Due to the configuration of the shaving blade assembly, the resilient element permits the blade to be movable, allowing the blade to better follow the natural contours of the user's body. Additionally, the holding means that holds the movable member in at least one position allows the user to hold the blade in a specific position relative to the shaving plane.

Accordingly, in at least one aspect, the shaving blade assembly may further comprise a plurality of blades. Including more blades increases the cutting surface area and reduces nicks, cuts, and skin irritation, as well as increases the lifetime of the cartridge by ensuring that the blades do not dull, especially when compared with shavers using a single blade razor.

Accordingly, in at least one aspect, the shaving assembly may further comprise a plurality of resilient elements. Including a plurality of resilient elements helps ensure that each blade is positioned in a manner to provide a consistent cut over its whole cutting edge, by following the contours of the skin.

Accordingly, in at least one aspect of the shaving blade assembly, the first movable member may be configured to be held in a plurality of different positions. A consequence of the movable member being permitted to be held in a plurality of positions is that the user has the option to hold the blade in a range of "bold" shaving to "sensitive" shaving.

Accordingly, in at least one aspect, the shaving blade assembly may further comprise a detent mechanism for holding the first movable member in the at least one position. The detent mechanism can be one of any suitable detent mechanisms, including, but not limited to: a spring loaded ball-lock mechanism with matching cavities or a protuberance and corresponding recesses. The detent mechanism allows the movable member to be held into place in order to avoid unwanted movement of the blade while shaving.

Accordingly, in at least one aspect of the shaving blade assembly, the first movable member may be configured to be held by friction in at least one position. Similar to the detent mechanism, the first movable member can be held into place by any frictional means, including, but not limited to mating textured surfaces. The frictional contact holding the movable member in place allows the movable member to be held, thereby avoiding accidental movement or release of the blade while shaving.

Accordingly, in at least one aspect of the shaving blade assembly, the first movable member may comprise a substantially arcuate segment. The arcuate segment makes it possible to fit the movable member in the interior of a housing of the shaving blade assembly. Having the movable member inside of the housing protects the movable member from being dislodged or toggled inadvertently. Additionally, the arcuate form allows for a larger and more substantial displacement of the blade.

Accordingly, in at least one aspect of the shaving blade assembly, extending between first and second ends in a direction parallel to a cutting edge of the blade, the first movable member being located at the first end and a second movable member being located at the second end, the second movable member being configured to abut the blade in the second direction opposite to the first direction and be held in at least one position.

Including a second movable member that is capable of being held in at least one position provides a heightened holding capability of the blade. Additionally, the second holdable movable member can ensure that the entire blade is held in a desired position thereby providing a constant distance from the shaving surface along the entire cutting blade edge.

Accordingly, in at least one aspect of the shaving blade assembly, the resilient element may be resilient in bending. Consequently, the flexibility of the resilient element permits the blade to be movable, allowing the blade to better follow the natural contours of the user's body, as well as ensure that the resilient element is durable and has a long life.

Another aspect of the present disclosure relates to providing a method of adjusting a shaving blade assembly, wherein the shaving blade assembly comprises a blade supported by a resilient element urging the blade in a first direction orthogonal to a cutting edge of the blade, and a first movable member abutting the blade in a second direction opposite to the first direction, wherein the method includes: moving the first movable member from an initial position to a final position in either one of the first or second directions; and at least one of: releasing the first movable member from being held in the initial position; and holding the first movable member in the final position.

The holding means that holds the movable member in at least one position allows the user to place the blade in a specific desired position relative to the shaving surface. An additional benefit is that the user may adjust the blade geometry without the use of a tool (e.g., using a finger) and at any time before, after, or during the shaving process.

Accordingly, in at least one aspect the first movable member moves along an arcuate path when moved between the initial and final positions. The arcuate path makes it possible to fit the movable member in the interior of a housing of the shaving blade assembly. Having the movable member inside of the housing protects the movable member from being dislodged or toggled inadvertently. Additionally, the arcuate path allows for a larger and more substantial displacement of the blade.

The above summary is not intended to describe each and every implementation of the concept. In particular, selected features of any illustrative embodiment within this disclosure may be incorporated into additional embodiments unless clearly stated to the contrary.

BRIEF DESCRIPTION OF THE DRAWINGS

The disclosure may be more completely understood in consideration of the following detailed description of aspects of the disclosure in connection with the accompanying drawings, in which.

Figure 1:
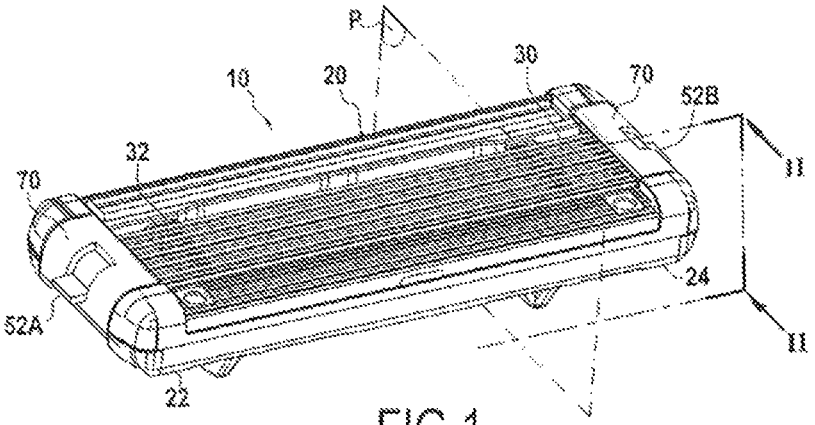
FIG. 1 is a perspective view of a shaving blade assembly according to a first example.

While aspects of the disclosure are amenable to various modifications and alternative forms, specifics thereof have been shown by way of example in the drawings and will be described in detail. It should be understood, however, that the intention is not to limit aspects of the disclosure to the particular embodiment described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the disclosure. The illustrative aspects depicted are intended only as exemplary.

Aspects of the disclosure relate to a shaving blade assembly 10 as shown on FIGS. 1 to 3B. FIG. 1 is a perspective view of a shaving blade assembly 10. The shaving blade assembly 10 has a hollow housing 20 that generally forms a rectangular parallelepiped, however the housing 20 may be any other suitable shape. The housing 20 may also include a guard bar, a cap, and a pair of substantially c-shaped retainers 70 each having a top portion, a bottom portion, a substantially convex portion connecting the top and bottom portions, where the retainers 70 are adapted to retain the position of the blades 30 within the housing 20. The retainers may extend along a pair of side edges of the housing 20 and are spaced apart and positioned on opposite sides of the housing 20. The retainers 70 may be either integral with the housing or a separate component assembled with the housing. Additionally, the shape of the retainers can be either complementary to the shape of a movable member 50A, 50B or not.

Secured within the housing 20 is at least one blade 30. In this embodiment, a plurality of blades 30 are shown, however, it is contemplated that the shaving blade assembly 10 may have any number of blades 30. Additionally, the blades 30 that are shown are elongate in shape; however, it is contemplated that the blades 30 may be formed into any other suitable shape. Each blade 30 has a cutting edge 32 that defines a line and is adapted to cut facial hair or body hair.

The blades 30 traverse the housing 20 between a first end 22 to a second end 24. The blades 30 may be partially exposed through an opening in the housing 20. Each blade 30 has two ends that correspond with the first and second ends of the housing 22, 24. The ends of the blades 30 may be oriented to extend beyond the boundaries of the opening in the housing 20 and be partially covered and unexposed. Additionally, each blade may be one piece, bent to form an angle, or may comprise a blade support attached on it.

Figure 2:
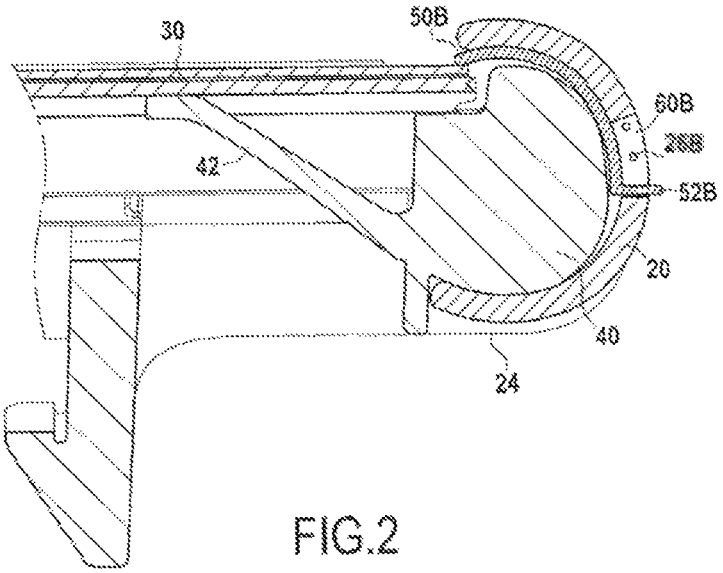
FIG. 2 is a cross-section cut along the plane II-II of the shaving blade assembly of FIG. 1.

Turning to FIG. 2, which is a cross-section along plane II-II in FIG. 1, a movable member 50B is disposed within the interior of the housing 20 and contacts the edge of blades 30. In this embodiment, the shaving blade assembly 10 has two movable members 50A, 50B, one on each side of the shaving blade assembly 22, 24. However, it is contemplated that the shaving blade assembly 10 may have any number of movable members 50A, 50B.

Each movable member 50A, 50B is formed into an arcuate shape and is adapted to slide along a corresponding arcuate track within the housing 20 (not shown). Each movable member 50A, 50B defines a lever 52A, 52B that extends outwardly. The housing 20 has corresponding windows 60A, 60B that allow the respective levers 52A, 52B to extend from the inside of the housing 20 to the exterior of the housing 20. Further, the levers 52A, 52B are adapted to be engaged by a user of the shaving blade assembly 10.

In this embodiment, the levers 52A, 52B of the movable members 50A, 50B are disposed on the ends 22, 24 of the shaving blade assembly 10; however, it is contemplated that the levers 52A, 52B may be disposed anywhere on the shaving blade assembly 10, for example, on the top surface, the bottom surface, or any other suitable location.

Encased within the housing 20 is a mounting structure 40 that has a flexible and resilient element 42 extending therefrom. In this embodiment, the resilient element 42 is an elongate spring finger, however the resilient element 42 can have any other suitable form, for example, a helical spring. The resilient element 42 may be composed of any type of appropriate single or multiple materials, including, but not limited to: a metal, polymer, composite material, or combination of them. It is envisioned that in this embodiment two resilient elements 42 are used, each being disposed on respective first and second sides 22, 24; however, it is contemplated that any number of resilient elements 42 may be used.

The resilient element 42 is adapted to contact the underside of each blade 30, which is the surface of the blade 30 that is facing the interior of the housing 20. Further, the resilient element 42 contacts all of the blades 30. The resilient element 42 may be integral with or assembled in the housing 20 with a pre-loaded stress such that the resilient element 42 may be adapted to urge or push the blades 30 in a first direction, specifically orthogonally to the cutting edge of the blade 30, toward the opening in the housing, thereby causing the ends of the blades 30 to contact or abut the respective movable members 50A, 50B. Orthogonally to the cutting edge of the blade 30 means any direction in a plane P perpendicular to the cutting edge. The shaving blade assembly 10 may include a plurality of resilient elements 42 at each end of the housing 20. In such a configuration, at least one of the plurality of resilient elements 42 contacts the blades 30 or the blade support.

In operation, when a normal force is applied to the outer surface of the blades 30 in a second direction (toward the inner cavity of the housing 20), which is opposite to the direction that the resilient element 42 is urging the blades 30, the blades 30 are configured to flex or bend the resilient element 42. The force applied to the blades 30 that bends the resilient element 42 causes the blades 30 to retract toward or into the interior of the housing 20. The force applied to the blades from the resilient elements may range from 0-0.4 N, most specifically may be 0.3 N. When the force is alleviated, the resilient element 42 urges the blades 30 in the first direction and against the movable members 50A, 50B.

Figure 3A:
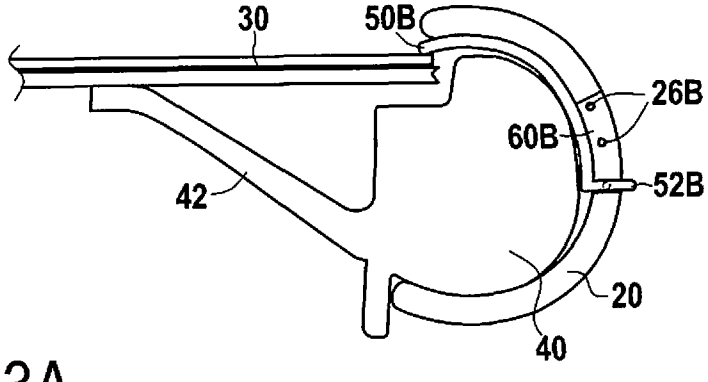
FIG. 3A is a schematic of the shaving blade assembly of FIG. 2 when the movable member is in an initial position.
Figure 3A:
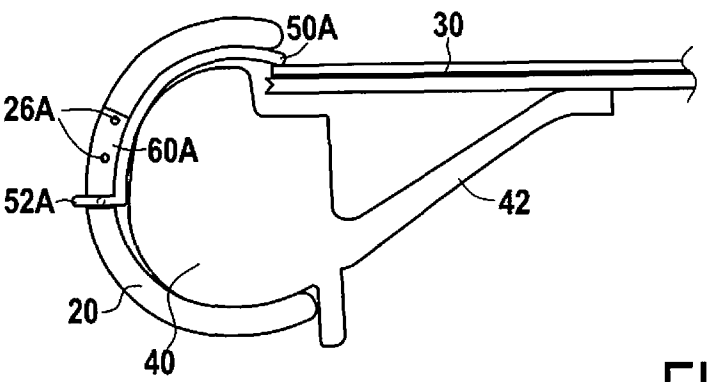
Figure 3B:
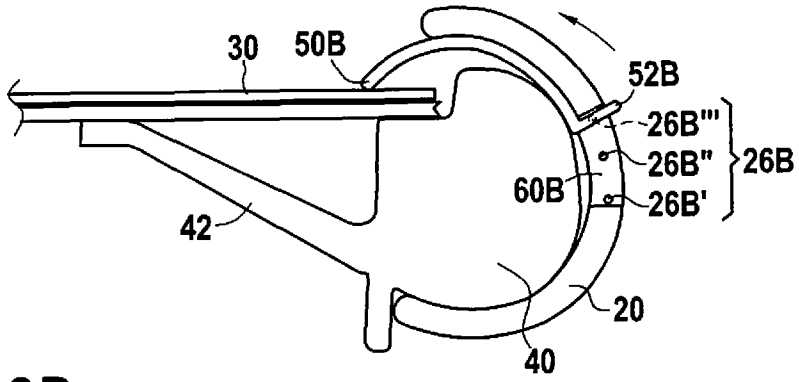
FIG. 3B is a schematic of the shaving blade assembly of FIG. 2 when the movable member is in a final position.
Figure 3B:
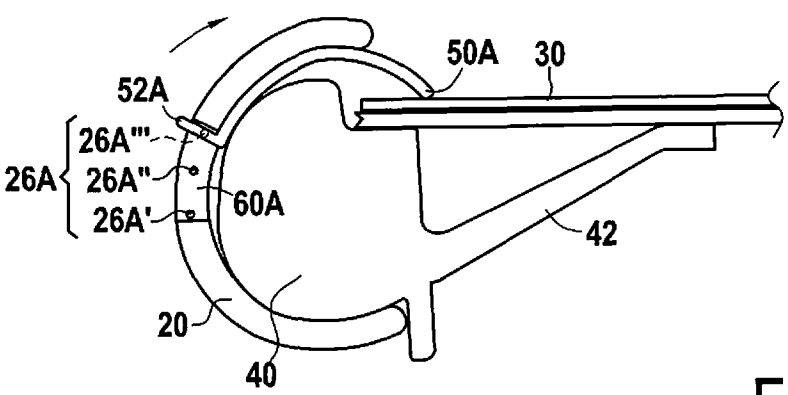

Turning to FIGS. 3A and 3B, the movable members 50A, 50B are adapted to apply a normal force on the blades 30 causing the blades 30 to move away from the shaving plane. Shown in FIG. 3A, the movable member 50B is in an initial or first position where the end of the blades 30 are resting against the movable member 50B. In this position, the blades 30 are approximate to the shaving plane.

In contrast, as shown in FIG. 3B, the movable member 50B is in a final or second position where the end of the blade 30 is abutting the movable member 50B, however the resilient element 42 is in a more flexed or bent position. In this configuration, the blades 30 are retracted deeper into the housing 20 and are further away from the shaving plane than when the movable member 50B was in the initial position.

Additionally, as can be seen in FIGS. 3A and 3B, the movable member 50B can be secured or held in place by a holding element 26B. Each movable member 50A, 50B has a respective holding element 26A, 26B. The holding element 26A, 26B holds the movable members 50A, 50B in order to avoid accidental movement or release of the position of the blades 30 while shaving. The holding element 26A, 26B holds or locks the movable members 50A, 50B into the initial position and/or final position. For illustrative purposes, only the initial and final positions are discussed, however it is contemplated that the movable member(s) 50A, 50B may be positioned in any number of positions or stages. Each of the holding positions places the blades 30 in a different position relative to the shaving plane. For example, as shown in FIG. 3B, when the position of the movable member 50B is at first holding position 26B', the head is at the "bold" setting, in which the blades are allowed maximum travel. At a second holding position 26B", the head is at a "sensitive" setting in which the blades are allowed less travel than in the first holding position 26B', and in position 26B'" the blades 30 are held against the mounting structure 40. The moveable member 50A may be similarly moved to positions 26A', 26A", and 26A'" as shown in FIG. 3B Additionally, a color coding or number system may be used with the holding element 26A, 26B to aid the user in selecting the correct position for each of the movable members 50A, 50B.

It is contemplated that any suitable holding element 26A, 26B may be implemented to hold the movable members 50A, 50B into place, including, but not limited to: a spring loaded ball-lock pin and corresponding recesses, a protrusion and matching cavities, or a frictional contact between the movable members 50 and the corresponding windows 60A, 60B of the housing 20. It is also contemplated that either one of the corresponding movable members 50A, 50B or windows 60A, 60B can have the ball lock/protrusion or cavities. For example, movable member 50B may have a protrusion and corresponding window 60B may have a cavity, or vice versa.

In the embodiment that has two movable members 50A, 50B on opposing sides of the shaving blade assembly 22, 24, the user should adjust each of the movable members 50A, 50B to be at the same holding position to achieve a uniform cutting performance. Adjusting the holding position can be done easily by applying pressure on the levers 52A, 52B of the movable members 50A, 50B, for example, a user can toggle each lever with their finger, to dislodge the holding elements 26A, 26B and move the blades 30 into a different position. If a user desires to have a cleaner and more bold shave, they can adjust the blades 30 such that the blades 30 are disposed close to the shaving plane. However, if a user desires a more sensitive and less bold shave, they can adjust the blades 30 further away from the shaving plane.

It is also contemplated that the shaving blade assembly 10 is adapted to attach to a razor handle and maybe interchangeable, for example, when the blades become dull or damaged. However, it is also contemplated that the shaving blade assembly may be permanently attached to a razor handle and can be used as a disposable razor.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A shaving blade assembly comprising:
at least one blade having a cutting edge,
at least one resilient element supporting the at least one blade and arranged to urge the at least one blade in a first direction orthogonal to the cutting edge; and
a first movable member, wherein:
the first movable member is configured to abut the at least one blade in a second direction opposite to the first direction,
the first movable member is further configured to be selectively held in a plurality of different first positions, and
the first movable member defines a lever that extends outwardly.

2. The shaving blade assembly of claim 1, wherein the at least one blade is a plurality of blades.

3. The shaving blade assembly of claim 1, wherein the at least one resilient element is a plurality of resilient elements.

4. The shaving blade assembly of claim 1, wherein the first movable member is configured to be held by friction in at least one position of the plurality of different first positions.

5. The shaving blade assembly of claim 1, wherein the first movable member comprises a substantially arcuate segment.

6. The shaving blade assembly of claim 1, further comprising a second movable member, wherein:
the at least one blade has a first end and an opposite second end,
the abutment between the first movable and the at least one blade is located at the first end, and
the second movable member is configured to abut the second end in the second direction and be held in at least one position of a plurality of different second positions.

7. The shaving blade assembly of claim 1, wherein the at least one resilient element is bendable.

8. The shaving blade assembly of claim 1, further comprising a housing configured to receive the at least one blade, wherein the housing supports the resilient element, the housing having at least one substantially C-shaped retainer configured to retain the at least one blade within the housing, wherein the lever extends outwardly away from the at least one substantially C-shaped retainer, is movable with respect to the at least one substantially C-shaped retainer, and is provided between the at least one substantially C-shaped retainer and the resilient element.

9. The shaving blade assembly of claim 8, wherein the at least one substantially C-shaped retainer is provided at an end of the at least one blade.

10. The shaving blade assembly of claim 1, further comprising a second movable member, wherein the second movable member defines a lever extending outwardly.

11. A shaving blade assembly comprising:
a blade,
a resilient element supporting the blade and arranged to urge the blade in a first direction orthogonal to a cutting edge of the blade;
a pair of substantially C-shaped retainers configured to retain a pair of ends, respectively, of the blade, and
a movable member configured to move with respect to the blade and the pair of substantially C-shaped retainers, wherein the first movable member is configured to abut the blade in a second direction opposite to the first direction and the movable member is further configured to be selectively held in a plurality of different positions.

12. The shaving blade assembly of claim 11, wherein the movable member defines a lever that extends outwardly.

13. The shaving blade assembly of claim 12, further comprising a housing configured to receive the blade, wherein the housing supports the resilient element, the housing having the pair of substantially C-shaped retainers, the pair of substantially C-shaped retainers being configured to retain the pair of ends, respectively, of the blade within the housing, wherein the lever extends outwardly away from one substantially C-shaped retainer of the pair of substantially C-shaped retainers and is provided between the one substantially C-shaped retainer and the resilient element.

14. The shaving blade assembly of claim 13, wherein the substantially C-shaped retainers are provided at opposite sides of the housing.

15. The shaving blade assembly of claim 13, wherein the one substantially C-shaped retainer includes a window, and the lever extends through the window.

16. A method of adjusting a shaving blade assembly, wherein the shaving blade assembly comprises a blade supported by a resilient element configured to urge the blade in a first direction orthogonal to a cutting edge of the blade, and a movable member abutting the blade in a second direction opposite to the first direction, wherein the method includes:

moving the movable member between an initial position and a final position; and at least one of:

releasing the movable member from being held in the initial position; or holding the movable member in the final position, wherein the movable member includes a lever.

17. The method of claim 16, wherein the movable member is configured to move along an arcuate path when moved between the initial and final positions.

18. The method shaving of claim 16, wherein the lever extends outwardly.

* * * * *